US010813505B2

(12) United States Patent
Lin

(10) Patent No.: US 10,813,505 B2
(45) Date of Patent: Oct. 27, 2020

(54) BATHING AUXILIARY CHAIR

(71) Applicant: Forever Young Enterprise Co., Ltd., New Taipei (TW)

(72) Inventor: Fang-Sheng Lin, Tainan (TW)

(73) Assignee: Forever Young Enterprise Co., Ltd., New Taipei (TW)

( * ) Notice: Subject to any disclaimer, the term of this patent is extended or adjusted under 35 U.S.C. 154(b) by 0 days.

(21) Appl. No.: 16/561,179

(22) Filed: Sep. 5, 2019

(65) Prior Publication Data

US 2020/0085243 A1 Mar. 19, 2020

Related U.S. Application Data

(63) Continuation-in-part of application No. 16/167,604, filed on Oct. 23, 2018, now Pat. No. 10,542,848.

(30) Foreign Application Priority Data

Sep. 14, 2018 (TW) ..... 107132509 A

(51) Int. Cl.
*A47K 3/12* (2006.01)
*A61G 5/10* (2006.01)

(52) U.S. Cl.
CPC ..... *A47K 3/122* (2013.01); *A61G 5/1059* (2013.01); *A61G 5/1072* (2013.01)

(58) Field of Classification Search
CPC ..... A47K 3/122; A61G 5/1059; A61G 5/1072
USPC ..... 4/549, 578.1
See application file for complete search history.

(56) References Cited

U.S. PATENT DOCUMENTS

| | | | | |
|---|---|---|---|---|
| 3,718,385 | A | 2/1973 | Gibson | |
| 4,359,791 | A * | 11/1982 | Thomas | A47K 3/122 4/546 |
| 5,606,751 | A | 3/1997 | Baker | |
| 6,681,415 | B1 | 1/2004 | Gallo | |
| 2008/0148473 | A1* | 6/2008 | Cheng | A61G 7/1059 4/578.1 |
| 2017/0172353 | A1* | 6/2017 | Chao | A47K 3/122 |

* cited by examiner

*Primary Examiner* — Tuan N Nguyen
(74) *Attorney, Agent, or Firm* — Alan D. Kamrath; Mayer & Williams PC

(57) ABSTRACT

A bathing auxiliary chair suitable for bathtubs of different sizes generally includes a seating unit and a supporting unit. The seating unit, which allows a user to sit thereon while bathing, is supported by the supporting unit and can be moved between a first position and a second position. The seating unit is provided with a front guide shell and two rear guide shells. In use, when the seating unit is located at the first position or the second position, one of the rear guide shells can abut against a fastener located at a rear tube of the supporting unit, and the front guide shell can be coupled to a front tube of the supporting unit through a button of a snap mechanism, so that the seating unit can be fixed at the position reliably, and the bathing auxiliary chair can be used safely.

10 Claims, 12 Drawing Sheets

BATHING AUXILIARY CHAIR

CROSS REFERENCE TO RELATED APPLICATION

This is a continuation-in-part application of U.S. patent application Ser. No. 16/167,604 filed Oct. 23, 2018.

BACKGROUND OF THE INVENTION

1. Field of the Invention

The present invention relates to a bathing auxiliary chair and, more particularly, to a chair that can be adjusted in lateral width to be applied to bathtubs of different sizes to facilitate mobility-impaired persons taking a bath.

2. Description of the Related Art

Persons with disabled lower limbs or impaired mobility cannot live independently. They often rely on carers and assistant devices in daily living activities, such as getting up, rehabilitating, or bathing. In a bathing activity, a carer should assist a disabled person to move into a bathroom, and then help the disabled person sitting on a bathing auxiliary chair to proceed with a bath. In conventional chairs for assisting baths, the seat portion thereof is usually secured on its supportive legs. When the disabled person wants to change the position during the bathing process, it is a laborious and difficult task for the carer, and it is prone to danger for the disabled person. Although some bathing auxiliary chair is provided with a movable seat portion, the seat portion is not convenient for moving in multiple positions. Besides, since the seat portion thereof cannot be fixed properly after changing its position, the chair is easy to shake, thus causing a danger to the user. In particular, when leaving or sitting on the chair, users usually need to hold the armrest of the chair. If the seat portion or the armrest of the chair is subjected to excessive force, the chair may shake or become tilted. Another disadvantage is that the conventional bath chair can only be applied to a bathtub of a specific size.

BRIEF SUMMARY OF THE INVENTION

Thus, an objective of the present invention is to provide a bathing auxiliary chair, which can be adjusted in lateral width to be applied to bathtubs of different sizes. Furthermore, the seating portion of the bathing auxiliary chair can be moved laterally and fixed reliably, so that the chair can be used more convenient and safely.

To achieve this and other objectives, a bathing auxiliary chair of the present invention, which can be positioned over a bathtub for allowing a mobility-impaired person to take a bath while sitting thereon, generally includes a seating unit, a supporting unit, and first and second snap mechanisms. The seating unit includes a fixed plate, a seat portion mounted above the fixed plate, a front guide shell provided at a front side of the fixed plate, and at least one rear guide shell provided at a rear side of the fixed plate. The front guide shell defines a central through-hole and a positioning hole communicating with the through-hole. The supporting unit includes two lateral supportive frames and front and rear tubes connected between the lateral supportive frames. The lateral supportive frames are spaced in a transverse direction and adapted to stand on a tub floor surface in a bathtub and a floor surface outside the bathtub respectively. Each lateral supportive frame includes first and second support legs spaced in a longitudinal direction perpendicular to the transverse direction. Each of the first and second support legs includes an upper section extending in the transverse direction. The front and rear tubes each has a first end section and a second end section spaced from the first end section in the transverse direction. The front tube extends in the transverse direction through the front guide shell, and the first and second end sections of the front tube are respectively connected with the upper sections of the first support legs of the lateral supportive frames. The rear tube extends in the transverse direction through the at least one rear guide shell, and the first and second end sections of the rear tube are respectively connected with the upper sections of the second support legs of the lateral supportive frames. Each of the first end sections of the front and rear tubes is provided with a first fastener to be connected to the upper section of one of the first and second support legs. The front tube defines a first fixing hole adjacent to the first end section thereof and a second fixing hole adjacent to the second end section thereof. The seating unit can be moved along the front and rear tubes to have the positioning hole of the front guide shell aligned with one of the first and second fixing holes in the front tube. The first and second snap mechanisms are provided in the front tube corresponding to the first and second fixing holes respectively, and each of the first and second snap mechanisms includes an elastic member and a button capable of being urged by the elastic member to allow a front end of the button to enter one of the first and second fixing holes in the front tube. When the positioning hole of the front guide shell is aligned with the first fixing hole of the front tube, the front end of the button of the first snap mechanism enters the positioning hole of the front guide shell, and the at least one rear guide shell abuts against the first fastener located at the rear tube. When the positioning hole of the front guide shell is aligned with the second fixing hole of the front tube, the front end of the button of the second snap mechanism enters the positioning hole of the front guide shell.

In a preferred form, each of the first end sections of the front and rear tubes is provided with a connection hole, and the upper section of the one of the first and second support legs defines a plurality of adjustment holes. The first fastener is engaged in one of the adjustment holes of the upper section and the connection hole of the first end section, allowing a distance between the two lateral supportive frames in the transverse direction to be adjusted.

In a preferred form, each of the first and second support legs is telescopically coupled to a leg tube which is provided with a plurality of spaced positioning holes. Each of the first and second support legs is provided with a positioning button for being engaged in one of the positioning holes.

In a preferred form, each of the second end sections of the front and rear tubes is provided with a second fastener to be connected to the upper section of one of the first and second support legs. When the positioning hole of the front guide shell is aligned with the second fixing hole of the front tube, the at least one rear guide shell abuts against the second fastener located at the rear tube.

In a preferred form, the at least one rear guide shell defines two outer ends close to the first and second end sections of the rear tube respectively. When the positioning hole of the front guide shell is aligned with the first fixing hole of the front tube, the outer end close to the first end section of the rear tube abuts against the first fastener located at the rear tube. When the positioning hole of the front guide shell is aligned with the second fixing hole of the front tube, the outer end close to the second end section of the rear tube abuts against the second fastener located at the rear tube.

In a preferred form, the upper section of each of the first and second support legs defines a plurality of adjustment holes, and each of the front and rear tubes defines two connection holes respectively in the first and second end sections thereof. Each of the first and second fasteners is engaged in one of the adjustment holes of the upper section and one of the connection holes of the front and rear tubes, allowing a distance between the two lateral supportive frames in the transverse direction to be adjusted.

In a preferred form, the elastic member of each of the first and second snap mechanisms is substantially V-shaped and includes a first end connected with an associated button and a second end urged against an inner surface of the front tube.

In a preferred form, the front guide shell is provided with a cylindrical hollow body defining a bore communicating with the positioning hole of the front guide shell. The bathing auxiliary chair further includes an operation unit including an actuating stem inserted into the bore of the cylindrical hollow body. When the actuating stem is moved inwardly towards the positioning hole, the associated button is pushed by an inner end of the actuating stem to be clear of the positioning hole, so that the front guide shell is decoupled from the front tube.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

DETAILED DESCRIPTION OF THE INVENTION

A bathing auxiliary chair according to an embodiment of the present invention is shown in FIGS. 1 through 9 of the drawings and generally designated 10. The bathing auxiliary chair 10 can be positioned over a bathtub 12 and provide persons, who are disabled or impaired in mobility, to take a bath. The bathing auxiliary chair 10 can be adjusted in lateral width, so that it can be applied to bathtubs of different sizes. When a seat portion of the bathing auxiliary chair 10 is moved to a location outside of the bathing area, the chair 10 can be fixed reliably, so that a user can leave or sit on the chair 10 conveniently and safely.

Figure 9:
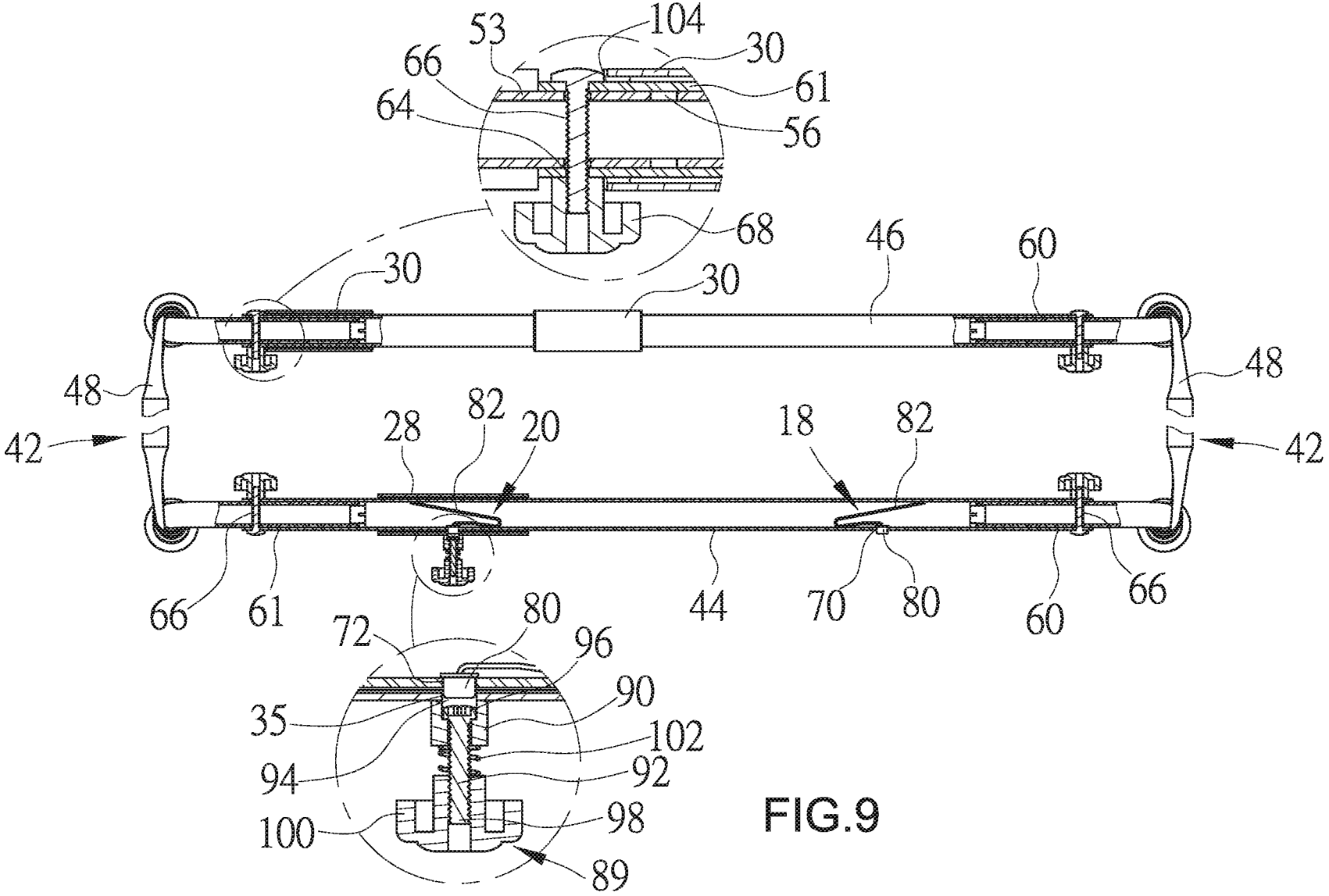
FIG. 9 shows a schematic view of the supporting unit and enlarged views of two circled portions in the schematic view, wherein a snap mechanism coupling a front guide shell to a front tube at a second position is demonstrated.

The bathing auxiliary chair 10 generally includes a seating unit 14, a supporting unit 16, and first and second snap mechanisms 18, 20 (see FIG. 9). The seating unit 14 includes a fixed plate 21, a seat portion 22, two arms 24 at two opposite lateral sides of the seat portion 22, and a back portion 26 at a rear side of the seat portion 22. The fixed plate 21 is provided with a front guide shell 28 at its front side, and at least one rear guide shell 30 at its rear side. In this embodiment, two spaced rear guide shells 30 are provided at the rear side of the fixed plate 21 (see FIG. 7). In another embodiment, the rear guide shells 30 can be joined together. The front guide shell 28 defines a central through-hole 32, in which a bush 34 can be provided, and a positioning hole 35 (see FIG. 6), which communicates with the central through-hole 32. The bush 34 defines a slot 36 which communicates with the positioning hole 35. The seat portion 22 is mounted above the fixed plate 21. In this embodiment, a movable plate 38 is provided between the seat portion 22 and a fixed plate 21, and the seat portion 22 is joined to the movable plate 38 (see FIG. 3). More specifically, the movable plate 38 can be fixed to the fixed plate 21 by a positioning pin 41, and the movable plate 38 can be rotated about the fixed plate 21 by an operation bar 40 to adjust the orientation of the seat portion 22. Since the present invention does not focus on the orientation adjustment mechanism for the seat portion 22, more detailed description therefor is omitted.

The supporting unit 16 includes two lateral supportive frames 42 and front and rear tubes 44, 46 which are connected between the lateral supportive frames 42 and pass over a sidewall 54 of the bathtub 12. The lateral supportive frames 42 are spaced in a transverse direction and adapted to stand on a tub floor surface in the bathtub 12 and a floor surface outside the bathtub 12, respectively (see FIG. 4). Each lateral supportive frame 42 includes first and second support legs 50, 52 and a connection rod 48 connecting the first and second support legs 50, 52. The first and second support legs 50, 52 are spaced in a longitudinal direction perpendicular to the transverse direction and each includes an upper section 53 extending in the transverse direction and defining a plurality of adjustment holes 56. In this embodiment, each of the first and second support legs 50, 52 is telescopically coupled to a leg tube 57 which is provided with a plurality of spaced positioning holes 58. Furthermore, each of the first and second support legs 50, 52 is provided with a positioning button 59 for being engaged in one of the positioning holes 58 (see FIG. 5), such that the heights of the lateral supportive frames 42 are adjustable (see FIG. 1).

Each of the front and rear tubes 44, 46 has a first end section 60, a second end section 61, and an intermediate section 62 between the first and second end sections 60, 61. The front tube 44 extends in the transverse direction through the front guide shell 28 to have the first and second end sections 60, 61 thereof connected with the upper sections 53 of the first support legs 50 of the lateral supportive frames 42. The rear tube 46, which is parallel to the front tube 44, extends in the transverse direction through the rear guide shells 30 to have the first and second section end sections 60, 61 thereof connected with the upper sections 53 of the second support legs 52 of the lateral supportive frames 42. As such, the seating unit 14 can be movably installed on the front tube 44 and the rear tube 46. Further, the front guide shell 28 and the rear guide shells 30 each can be provided therein with the bush 34 to facilitate the front and rear guide shells 28, 30 moving along the front and rear tubes 44, 46. Furthermore, the front and rear tubes 44, 46 can be adjustably connected to at least one of the two lateral supportive frames 42, so that the distance between the lateral supportive frames 42 in the transverse direction can be adjusted (see FIG. 7). Thus, the bathing auxiliary chair 10 can be applied to bathtubs of different sizes. In this embodiment, each of the front and rear tubes 44, 46 defines two connection holes 64 respectively at its first and second end sections 60, 61, and a fastener 66 extends through each of the connection holes 64. More specifically, one of the fasteners 66 can be inserted through a corresponding connection hole 64 of the front tube 44 and one of the adjustment holes 56 of the first support leg 50. Similarly, one of the fasteners 66 can be inserted through a corresponding connection hole 64 of the rear tube 46 and one of the adjustment holes 56 of the second support leg 52. Thus, the front and rear tubes 46 can be adjustably connected between the two lateral supportive frames 42 (see FIG. 7). More specifically, each fastener 66 can be made in the form of a bolt, and a nut 68 can be releasably connected with the bolt to prevent the fastener 66 from being disengaged from the connection hole 64. In use, one of the lateral supportive frames 42 can be detached from the front and rear tubes 44, 46 by taking apart two corresponding fasteners 66 and nuts 68. Next, each of the fasteners 66 is inserted through a corresponding connection hole 64 and another adjustment hole 56 to connect the lateral supportive frame 42 with the front and rear tubes 44, 46, thus adjusting the distance between the lateral supportive frames 42.

Figure 1:
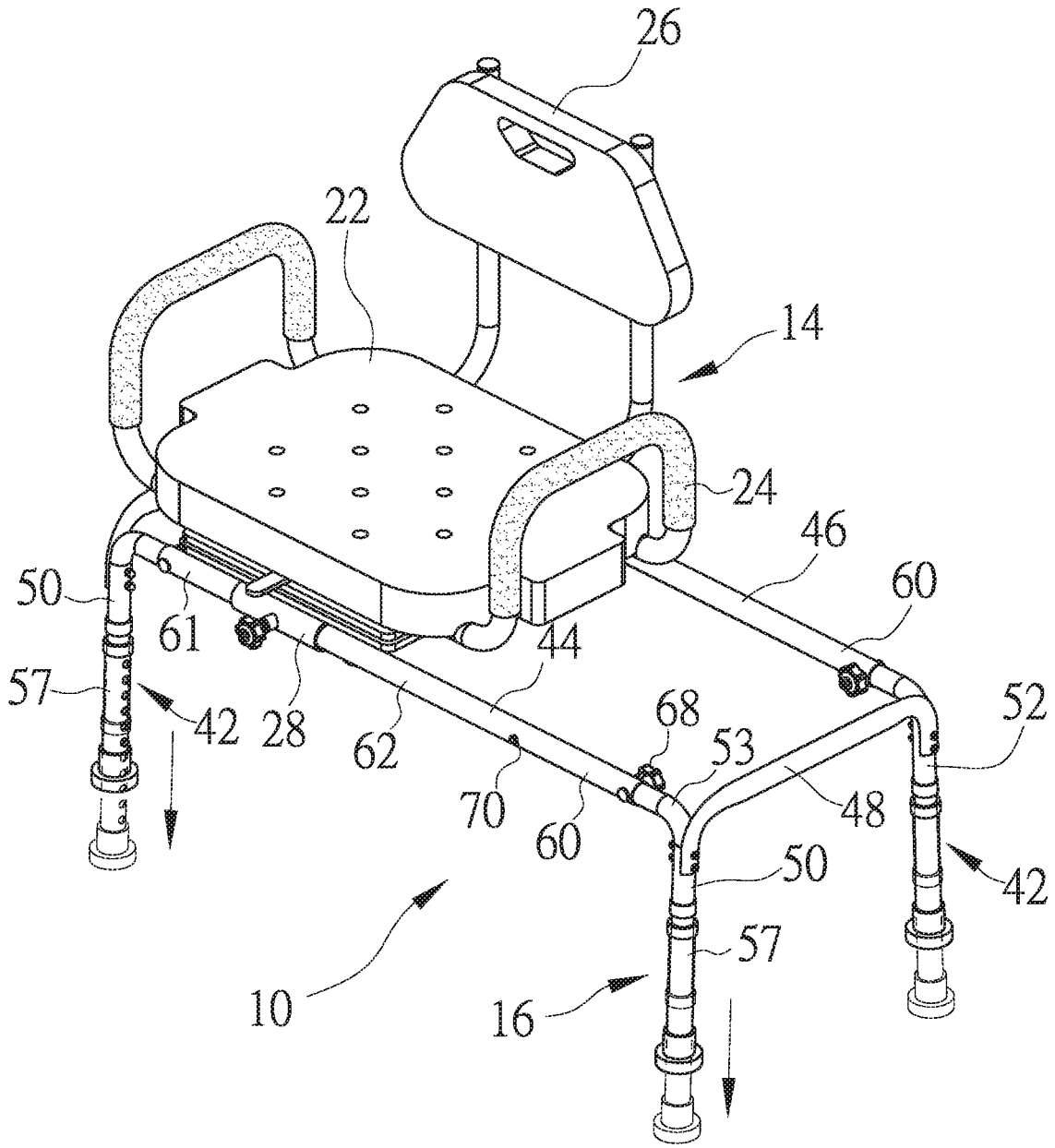
FIG. 1 shows a perspective view of a bathing auxiliary chair in accordance with an embodiment of the present invention.
Figure 2:
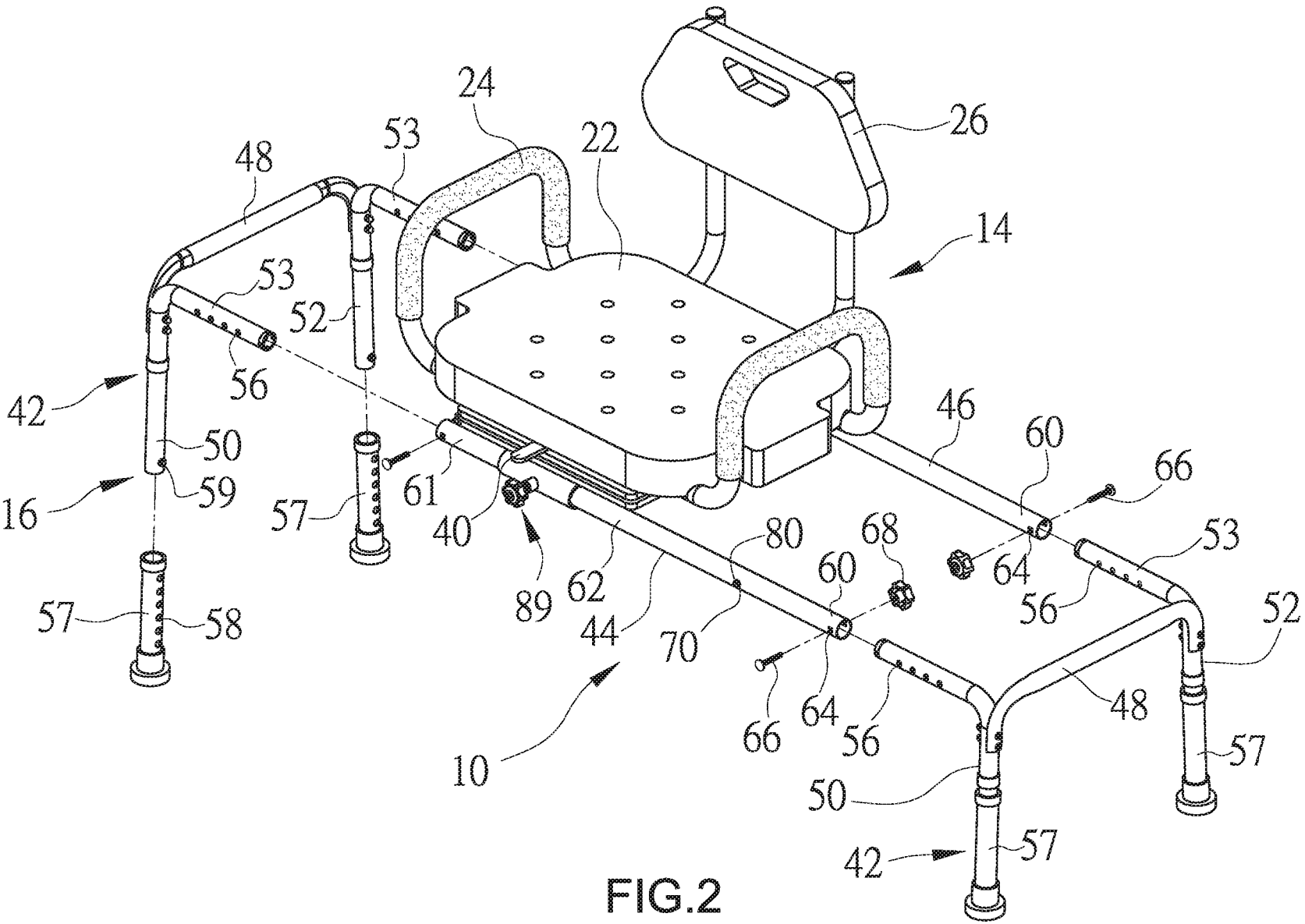
FIG. 2 shows an exploded view of the bathing auxiliary chair of FIG. 1.
Figure 3:
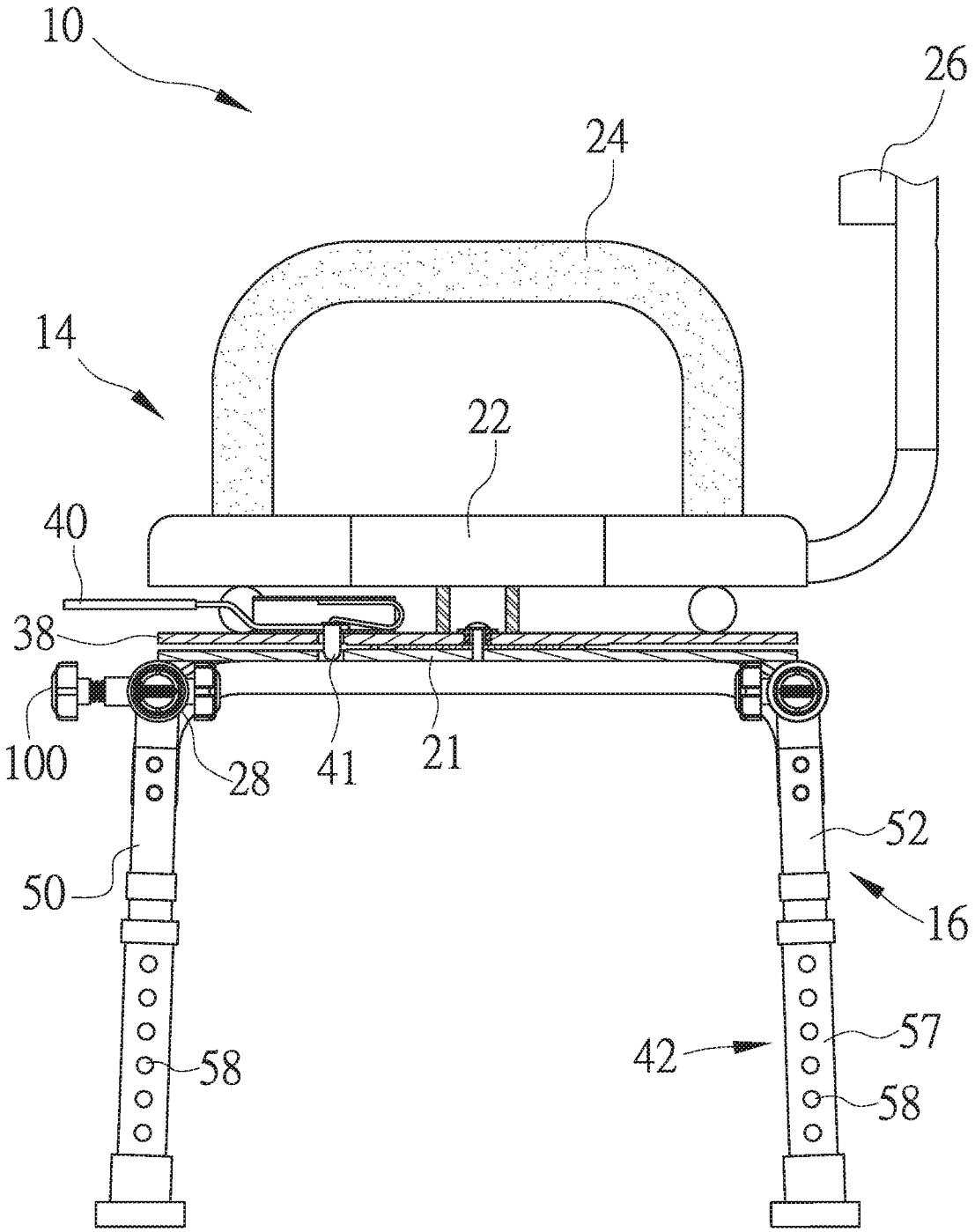
FIG. 3 shows a sectional view of the bathing auxiliary chair of FIG. 1.
Figure 4:
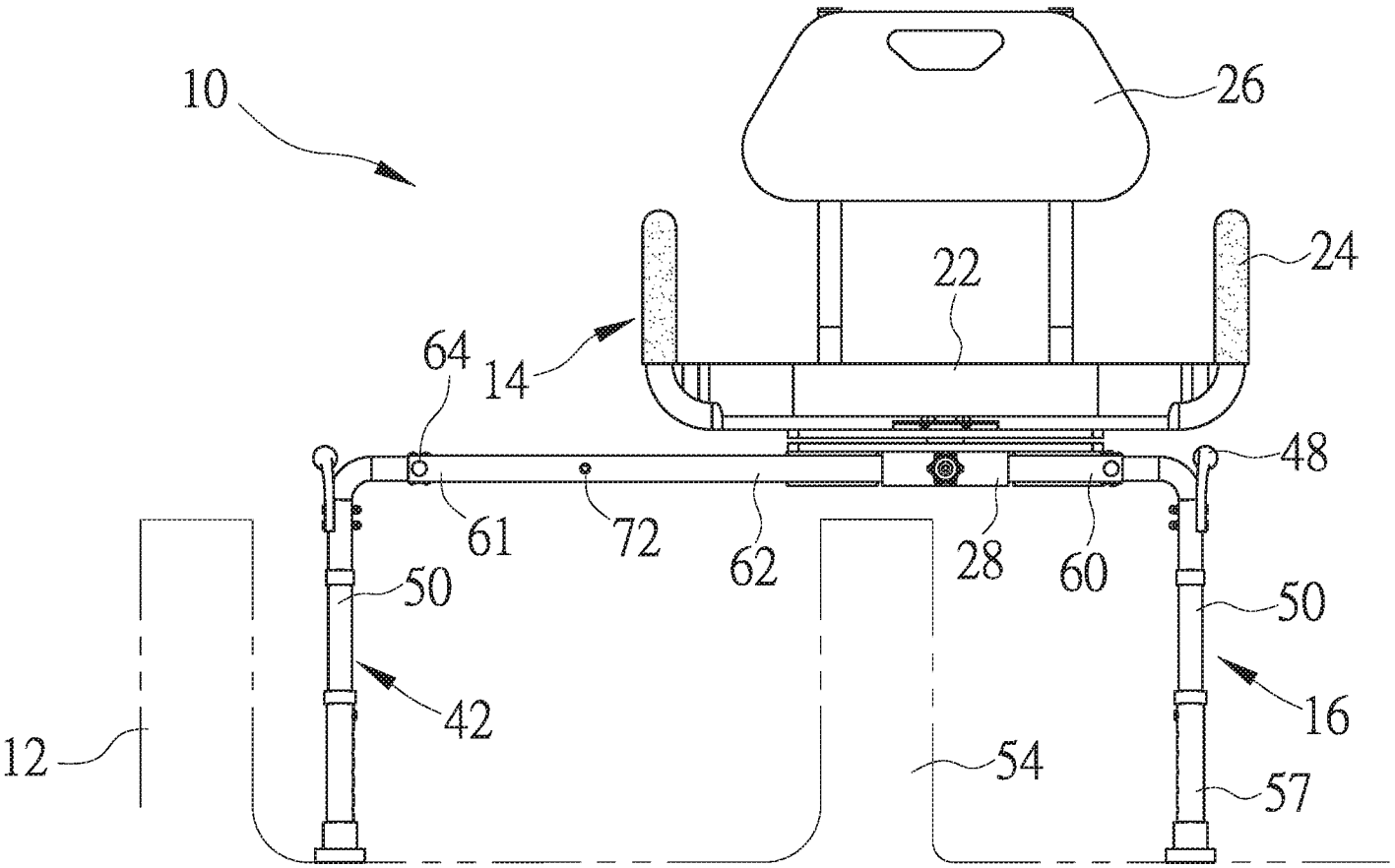
FIG. 4 shows a schematic view of the bathing auxiliary chair of FIG. 1 in a bathtub application, with a seating unit thereof located outside of the bathing area.
Figure 5:
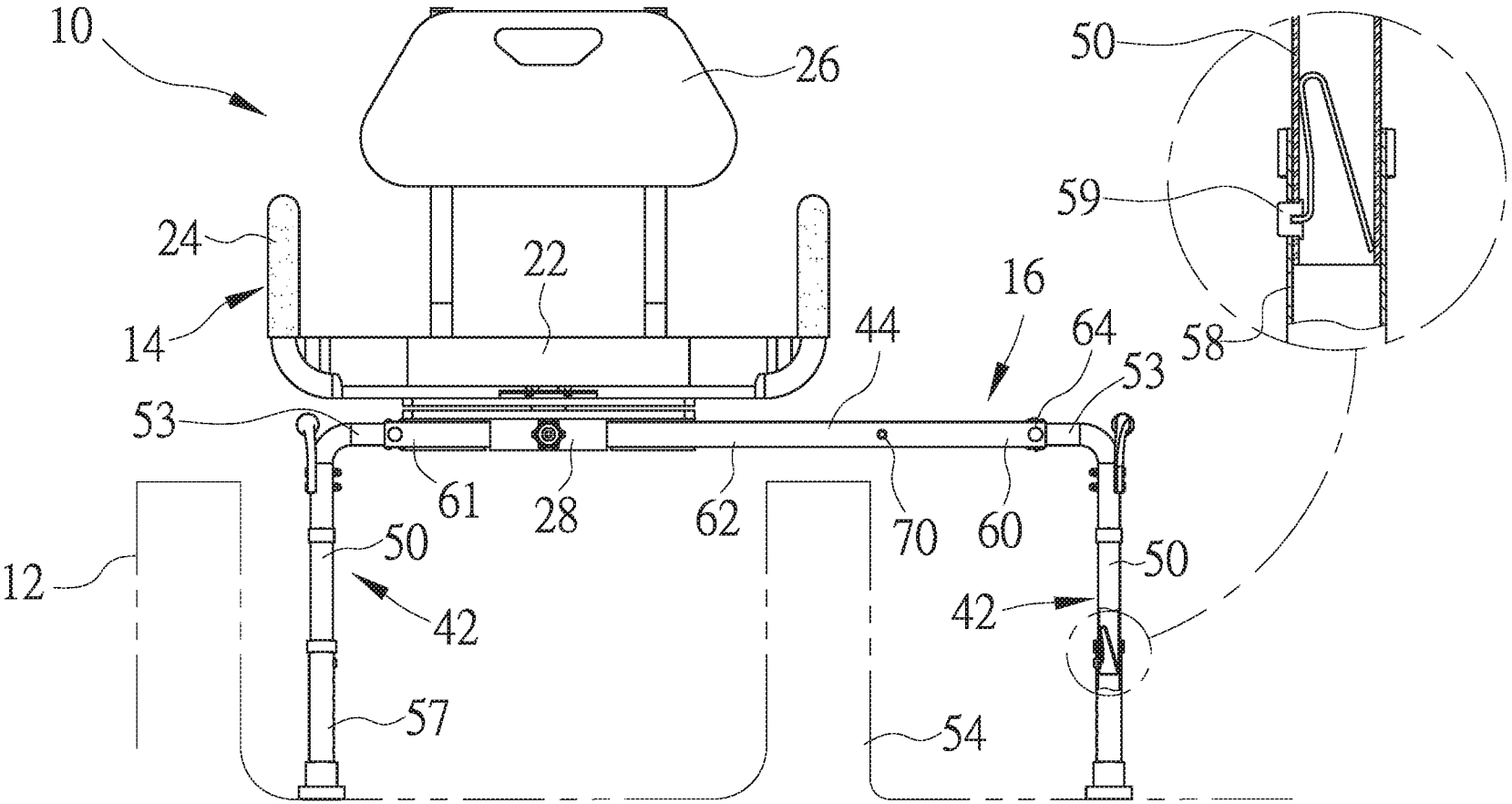
FIG. 5 shows a schematic view similar to FIG. 4, with the seating unit thereof located in the bathtub.
Figure 6:
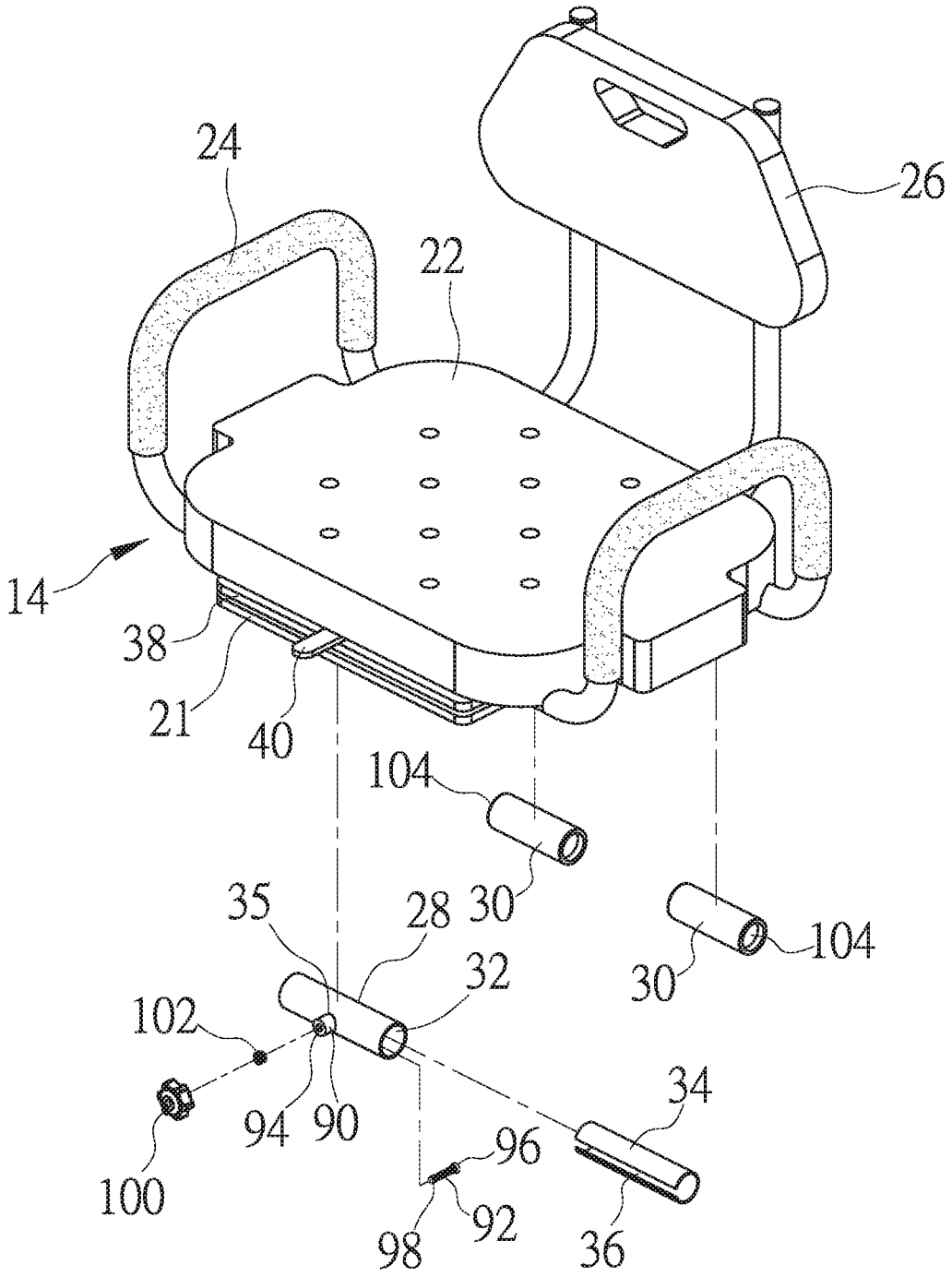
FIG. 6 shows an exploded view of the seating unit of the bathing auxiliary chair of FIG. 1.
Figure 7:
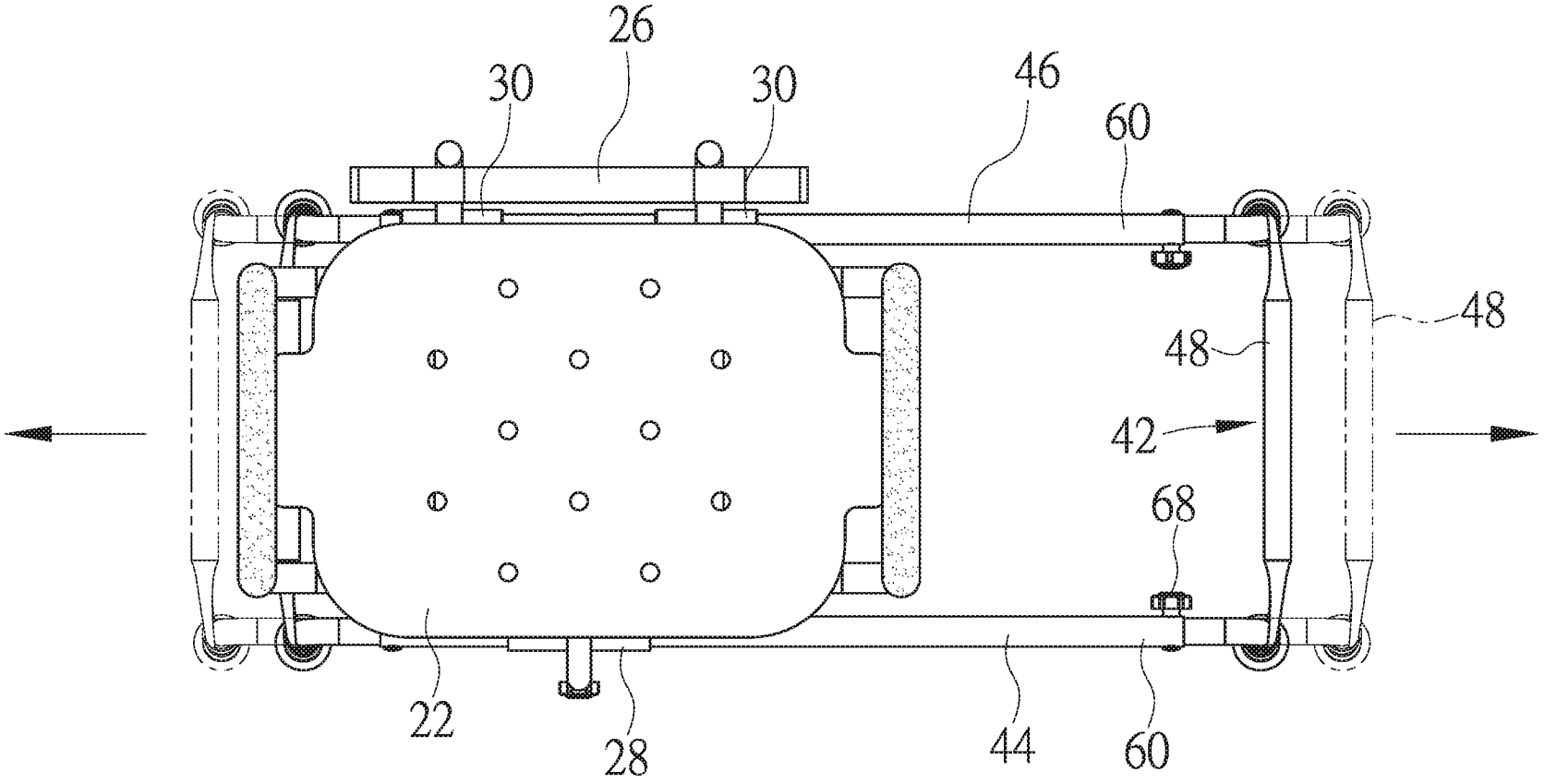
FIG. 7 shows a top view of the bathing auxiliary chair of FIG. 1, wherein a supporting unit thereof capable of being adjusted in width is demonstrated.
Figure 8:
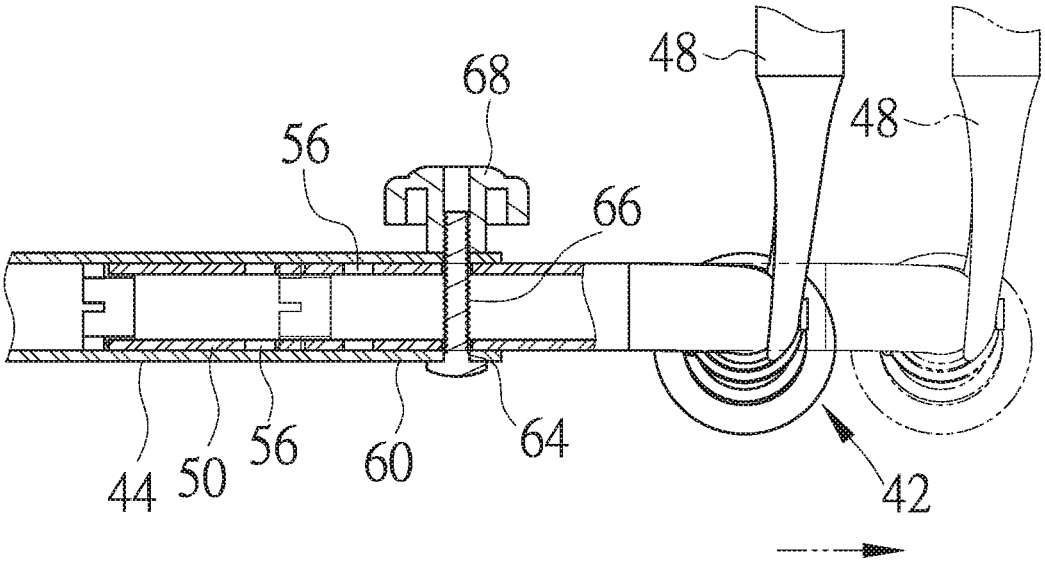
FIG. 8 shows a partial, enlarged, sectional view in FIG. 7, wherein the front guide shell capable of moving along the front tube is demonstrated.
Figure 12:
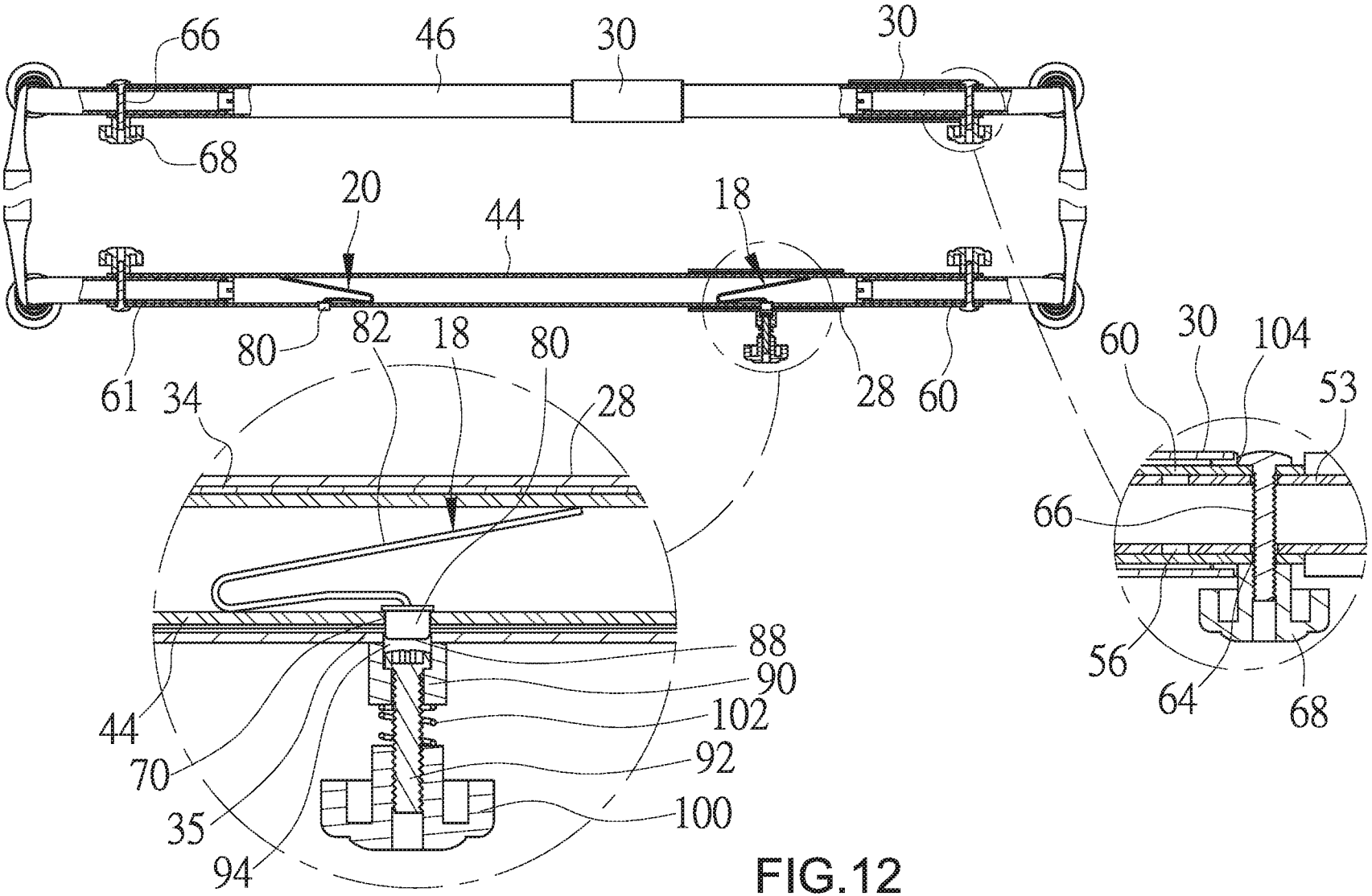
FIG. 12 shows a schematic view similar to FIG. 9 and enlarged views of two circled portions in the schematic view, wherein a snap mechanism coupling the front guide shell to a front tube at a first position is demonstrated.

As shown in FIGS. 1, 4 and 5, the front tube 44 defines a first fixing hole 70 and a second fixing hole 72. The first fixing hole 70 is adjacent to the first end section 60 and located between the intermediate section 62 and the connection hole 64 (the fastener 66) defined at the first end section 60. The second fixing hole 72 is adjacent to the second end section 61 and located between the intermediate section 62 and the connection hole 64 (the fastener 66) defined at the second end section 61. When the seating unit 14 together with the front and rear guide shells 28, 30 are moved along the front and rear tubes 44, 46, the positioning hole 35 of the front guide shell 28 can be aligned with the second fixing hole 72 or the first fixing hole 70 (see FIGS. 9 and 12).

Figure 10:
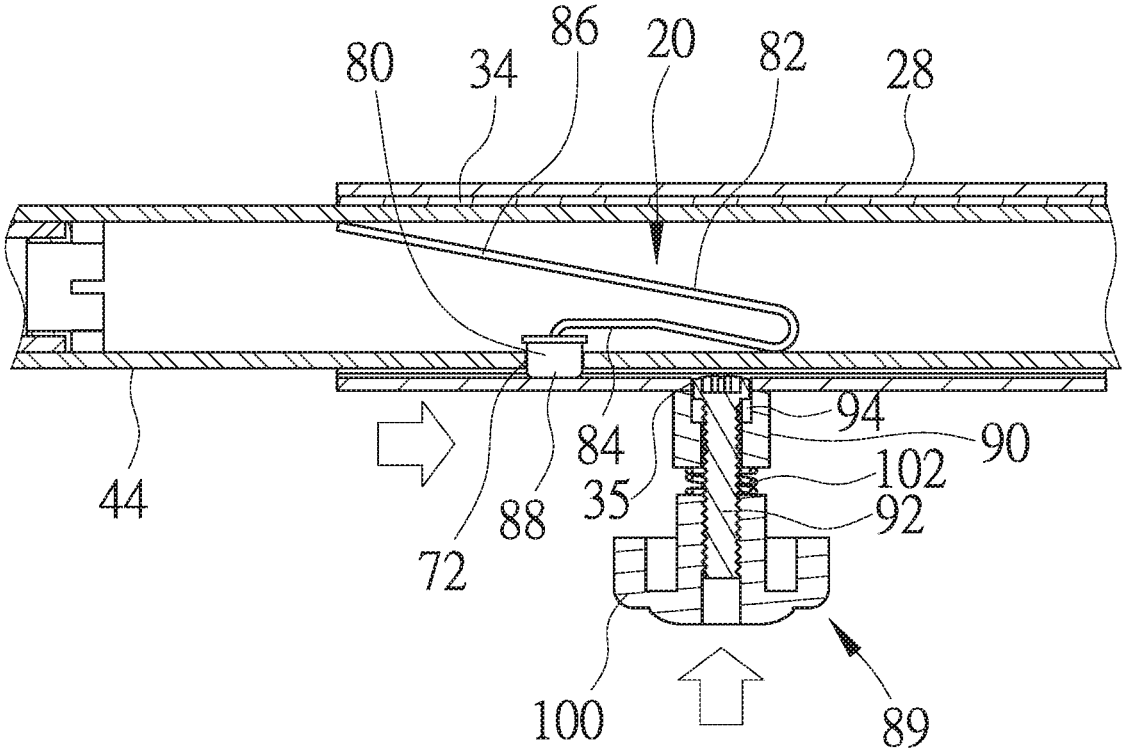
FIG. 10 shows an enlarged fragmentary view in FIG. 9, wherein the front guide shell decoupled from the front tube and capable of moving along the front tube is demonstrated.

The first and second snap mechanisms 18, 20 are provided in the front tube 44 corresponding to the first and second fixing holes 70, 72 respectively (see FIG. 9). Each snap mechanism includes a button 80 and a substantially V-shaped elastic member 82 which has a first end 84 connected with the button 80 and a second end 86 urged against an inner surface of the front tube 44 (see FIG. 10). Thus, the buttons 80 can be forced outwardly by the elastic members 82 to enter the first and second fixing holes 70, 72. More specifically, each button 80 has a front end 88, which is configured as a curved or bevel surface and can extend out of a corresponding fixing hole of the front tube 44. When the positioning hole 35 is aligned with the first fixing hole 70 or the second fixing hole 72, the front end 88 of one of the buttons 80 may enter the first fixing hole 70 or the second fixing hole 72, so that the front guide shell 28 is coupled to the front tube 44. On the other hand, when the button 80 is pushed inwardly, the front end 88 of the button 80 can be clear of the positioning hole 35, so that the front guide shell 28 is decoupled from the front tube 44.

The front guide shell 28 can be provided with a cylindrical hollow body 90 defining a bore 94 communicating with the positioning hole 35 of the front guide shell 28 (see FIG. 9). The bathing auxiliary chair 10 may further include an operation unit 89 including an actuating stem 92 inserted into the bore 94 of the cylindrical hollow body 90. The actuating stem 92 has an inner end 96 and an outer end 98. The inner end 96 is inserted into the bore 94, and the outer end 98 is connected with a press head 100. When the actuating stem 92 is moved inwardly towards the positioning hole 35, the button 80 entering the positioning hole 35 can be pushed by the inner end 96 of the actuating stem 92 to move back, thus being clear of the positioning hole 35. In this embodiment, the operation unit 89 may further include a coil spring 102 located between the cylindrical hollow body 90 and the press head 100. In an implementable embodiment, the spring 102 can be omitted.

Figure 11:
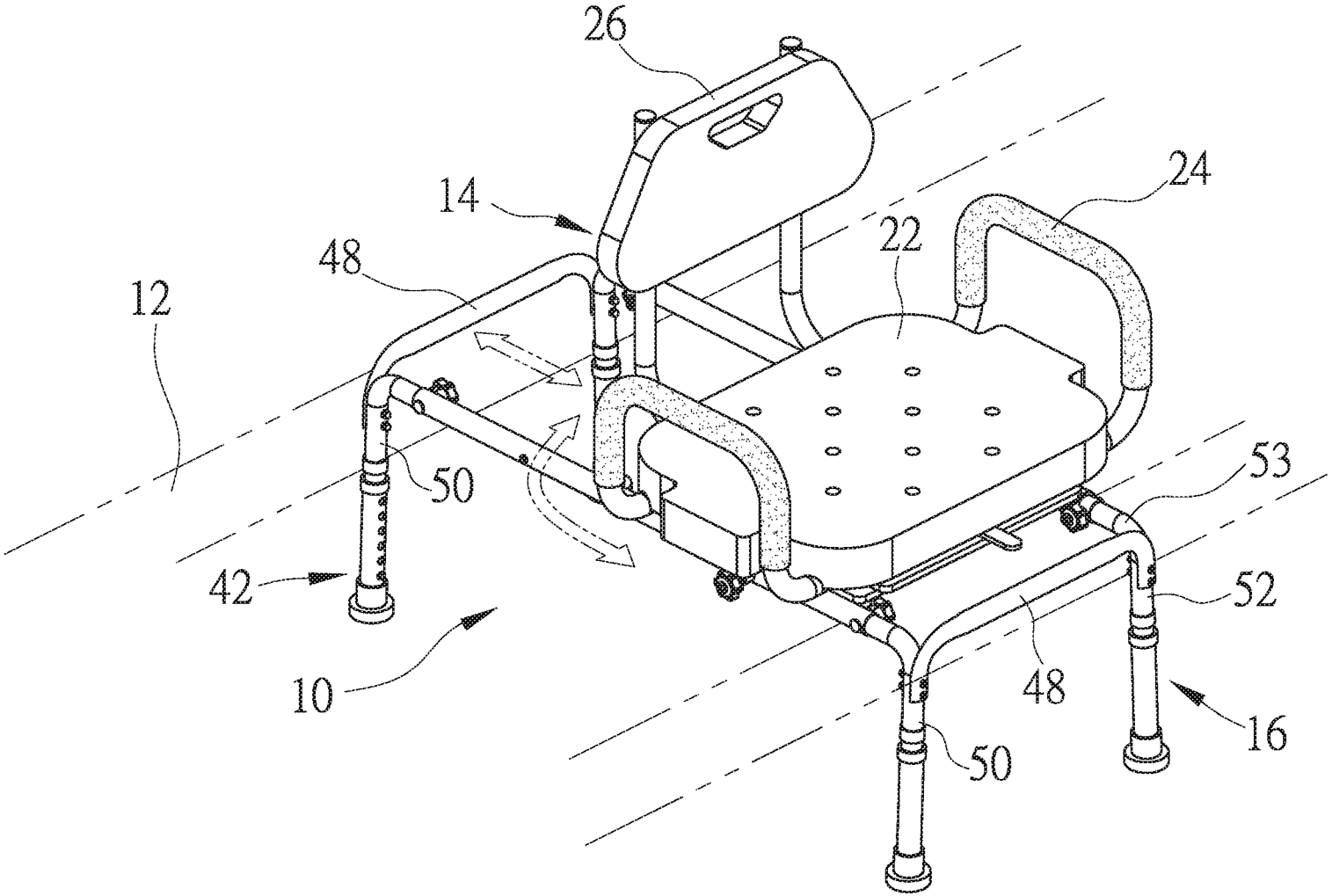
FIG. 11 shows a schematic view of the bathing auxiliary chair in FIG. 4, wherein the seating portion capable of rotating about 90 degrees is demonstrated.

Referring to FIGS. 4 and 5, the seating unit 14 of the bathing auxiliary chair 10 can be operated to move between a first position and a second position. When the seat portion 22 together with the front guide shell 28 is moved to the first position (close to the first end section 60, see FIG. 4), the front end 88 of the button 80 at the first fixing hole 70 enters the positioning hole 35 of the front guide shell 28, thus fixing the seating unit 14 at the first position (see FIG. 12). On the other hand, when the seat portion 22 together with the front guide shell 28 is moved to the second position (close to the second end section 61, see FIG. 5), the front end 88 of the button 80 at the second fixing hole 72 enters the positioning hole 35 of the front guide shell 28, thus fixing the seating unit 14 at the second position (see FIG. 9). When the seating unit 14 is located at the second position, the seat portion 22 is close to the central area of the bathtub 12, where a user can proceed with a bath easily. When the seating unit 14 is located at the first position, the seat portion 22 is close to the sidewall 54 of the bathtub 12. Furthermore, at the first position, the seat portion 22 can be adjusted in orientation to allow a user to leave or sit on the seat portion 22 easily (FIG. 11).

For moving the seating unit 14 from the second position to the first position, a user may depress the press head 100 to have the inner end 96 of the actuating stem 92 push the button 80, so that the front end 88 of the button 80 can be clear of the positioning hole 35 without requiring the button 80 to be removed from the first fixing hole 70. Thereafter, the user may push the front guide shell 28 together with seating unit 14 to move towards the first position (see FIG. 10). When the positioning hole 35 is aligned with the first fixing hole 70, the button 80 of the first snap mechanism 18 is urged by the associated elastic member 82 to have the front end 88 of the button enter the positioning hole 35 of the front guide shell 28, so that the seating unit 14 is fixed at the first position (see FIG. 12). On the other hand, for moving the seating unit 14 from the first position to the second position, the user may depress the press head 100 to push the button 80 to move inwardly, so that the front end 88 of the button 80 can be clear of the positioning hole 35. Next, the seating unit 14 can be pushed to move from the first position to the second position, and then the seating unit 14 is fixed at the second position.

Referring again to FIG. 4 and FIG. 12, when the seating unit 14 is located at the first position, in addition to the front guide shell 28 being coupled to the front tube 44 by the first snap mechanism 18, an outer end 104 of the rear guide shell 30 close to the first end section 60 of the rear tube 46 abuts against the fastener 66 at the first end section 60 of the rear tube 46. As such, the seating unit 14 can be fixed at the first position reliably to allow a user leaving or sitting on the chair 10 easily and safely. When the seating unit 14 is located at the second position, as shown in FIGS. 5 and 9, in addition to the front guide shell 28 being coupled to the front tube 44 by the second snap mechanism 20, an outer end 104 of the rear guide shell 30 close to the second end section 61 of the rear tube 46 abuts against the fastener 66 at the second end section 61 of the rear tube 46. As such, the seating unit 14 can be fixed at the second position reliably to allow a user to take a bath safely. In addition, the outer ends 104 of the rear guide shells 30 abut against the associated fasteners 66 to produce, for example, a slight impact sound or feel when the seating unit 14 has reached the first or second position, and this informs the user of the seating unit 14 having been moved to the position suitable for leaving or sitting on the seat portion 22.

The scope of the invention is to be indicated by the appended claims, rather than by the foregoing description, and all changes which come within the meaning and range of equivalency of the claims are intended to be embraced therein.

The invention claimed is:

1. A bathing auxiliary chair comprising:

a seating unit including a fixed plate, a seat portion mounted above the fixed plate, a front guide shell provided at a front side of the fixed plate, and at least one rear guide shell provided at a rear side of the fixed plate, with the front guide shell defining a central through-hole and a positioning hole communicating with the through-hole;

a supporting unit including two lateral supportive frames and front and rear tubes connected between the two lateral supportive frames, with the two lateral supportive frames spaced in a transverse direction and adapted to stand on a tub floor surface in a bathtub and a floor surface outside the bathtub respectively, with each lateral supportive frame including first and second support legs spaced in a longitudinal direction perpendicular to the transverse direction, with each of the first and second support legs including an upper section extending in the transverse direction, with the front and rear tubes each having a first end section and a second end section spaced from the first end section in the transverse direction, with the front tube extending in the transverse direction through the front guide shell, with the first and second end sections of the front tube respectively connected with the upper sections of the first support legs of the two lateral supportive frames, with the rear tube extending in the transverse direction through the at least one rear guide shell, with the first and second end sections of the rear tube respectively connected with the upper sections of the second support legs of the two lateral supportive frames, wherein each of the first end sections of the front and rear tubes is provided with a first fastener to be connected to the upper section of one of the first and second support legs, wherein the front tube defines a first fixing hole adjacent to the first end section thereof and a second fixing hole adjacent to the second end section thereof, wherein the seating unit can be moved along the front and rear tubes to have the positioning hole of the front guide shell aligned with one of the first and second fixing holes of the front tube; and first and second snap mechanisms provided in the front tube corresponding to the first and second fixing holes respectively, with the first and second snap mechanisms each including an elastic member and a button capable of being urged by the elastic member to allow a front end of the button to enter one of the first and second fixing holes of the front tube, wherein when the positioning hole of the front guide shell is aligned with the first fixing hole of the front tube, the front end of the button of the first snap mechanism enters the positioning hole of the front guide shell, and the at least one rear guide shell abuts against the first fastener located at the rear tube; wherein when the positioning hole of the front guide shell is aligned with the second fixing hole of the front tube, the front end of the button of the second snap mechanism enters the positioning hole of the front guide shell.

2. The bathing auxiliary chair of claim 1, wherein each of the first end sections of the front and rear tubes is provided with a connection hole, with the upper section of the one of the first and second support legs defining a plurality of adjustment holes, wherein the first fastener is engaged in one of the adjustment holes of the upper section and the connection hole of the first end section, allowing a distance between the two lateral supportive frames in the transverse direction to be adjusted.

3. The bathing auxiliary chair of claim 1, wherein each of the first and second support legs is telescopically coupled to a leg tube which is provided with a plurality of spaced positioning holes, with each of the first and second support legs provided with a positioning button for being engaged in one of the positioning holes.

4. The bathing auxiliary chair of claim 1, wherein each of the second end sections of the front and rear tubes is provided with a second fastener to be connected to the upper section of one of the first and second support legs, wherein when the positioning hole of the front guide shell is aligned with the second fixing hole of the front tube, the at least one rear guide shell abuts against the second fastener located at the rear tube.

5. The bathing auxiliary chair of claim 4, wherein the at least one rear guide shell defines two outer ends close to the first and second end sections of the rear tube respectively, wherein when the positioning hole of the front guide shell is aligned with the first fixing hole of the front tube, the outer end close to the first end section of the rear tube abuts against the first fastener located at the rear tube, wherein when the positioning hole of the front guide shell is aligned with the second fixing hole of the front tube, the outer end close to the second end section of the rear tube abuts against the second fastener located at the rear tube.

6. The bathing auxiliary chair of claim 5, wherein the at least one rear guide shell includes two spaced rear guide shells, with each rear guide shell defining one of the two outer ends of the at least one rear guide shell.

7. The bathing auxiliary chair of claim 4, wherein the upper section of each of the first and second support legs defines a plurality of adjustment holes, with each of the front and rear tubes defining two connection holes respectively in the first and second end sections thereof, wherein each of the first and second fasteners is engaged in one of the adjustment holes of the upper section and one of the connection holes of the front and rear tubes, allowing a distance between the two lateral supportive frames in the transverse direction to be adjusted.

8. The bathing auxiliary chair of claim 4, wherein each of the first and second support legs is telescopically coupled to a leg tube which is provided with a plurality of spaced positioning holes, with each of the first and second support legs provided with a positioning button for being engaged in one of the positioning holes.

9. The bathing auxiliary chair of claim 1, wherein the elastic member of each of the first and second snap mechanisms is substantially V-shaped and includes a first end connected with an associated button and a second end urged against an inner surface of the front tube.

10. The bathing auxiliary chair of claim 1, wherein the front guide shell is provided with a cylindrical hollow body defining a bore communicating with the positioning hole of the front guide shell, wherein the bathing auxiliary chair further includes an operation unit including an actuating stem inserted into the bore of the cylindrical hollow body, wherein when the actuating stem is moved inwardly towards the positioning hole, the associated button is pushed by an inner end of the actuating stem to be clear of the positioning hole, so that the front guide shell can be decoupled from the front tube.

* * * * *